United States Patent [19]

Dunham

[11] 4,173,186

[45] Nov. 6, 1979

[54] AMMUNITION

[75] Inventor: James V. Dunham, Jenkintown, Pa.

[73] Assignee: The United States of America as represented by the Secretary of the Army, Washington, D.C.

[21] Appl. No.: 41,459

[22] Filed: Jul. 7, 1960

[51] Int. Cl.[2] ..... F42B 5/02; F42B 9/00

[52] U.S. Cl. ..... 102/38 R; 102/43 R

[58] Field of Search ..... 102/38, 43, 44, 45, 102/93, 82, 38 R; 42/55, 54

[56] References Cited

U.S. PATENT DOCUMENTS

| | | | |
|---|---|---|---|
| 692,819 | 2/1902 | Bissell | 102/38 |
| 1,416,828 | 5/1922 | Holmes | 102/38 |
| 2,083,665 | 6/1937 | Pihl et al. | 102/43 |

FOREIGN PATENT DOCUMENTS

| | | | |
|---|---|---|---|
| 463057 | 12/1913 | France | 102/44 |
| 17307 | of 1894 | United Kingdom | 102/41 |
| 28093 | of 1896 | United Kingdom | 102/93 |

*Primary Examiner*—Harold Tudor

*Attorney, Agent, or Firm*—Nathan Edelberg; A. Victor Erkkila; Max Yarmovsky

EXEMPLARY CLAIM

1. A cartridge including a substantially rigid extractable case having at one of its ends a head formed to receive a propellant and to provide a primer support adjacent to said propellant, a projectile releasably coupled to the other end of said case, a piston engaging an inner end of said projectile and extending into said casing, said piston having a shoulder near its inner end, a base cup extending into and releasably coupled to said head, said cup enclosing the inner end of said piston with said end spaced from the bottom of said cup, and seal means between the rim of said cup and said shoulder, a second shoulder on said piston in front of the first shoulder, and a shoulder in said case for cooperation with the second mentioned shoulder on said piston in deceleration and deformation of said piston.

10 Claims, 4 Drawing Figures

AMMUNITION

Figure 1:
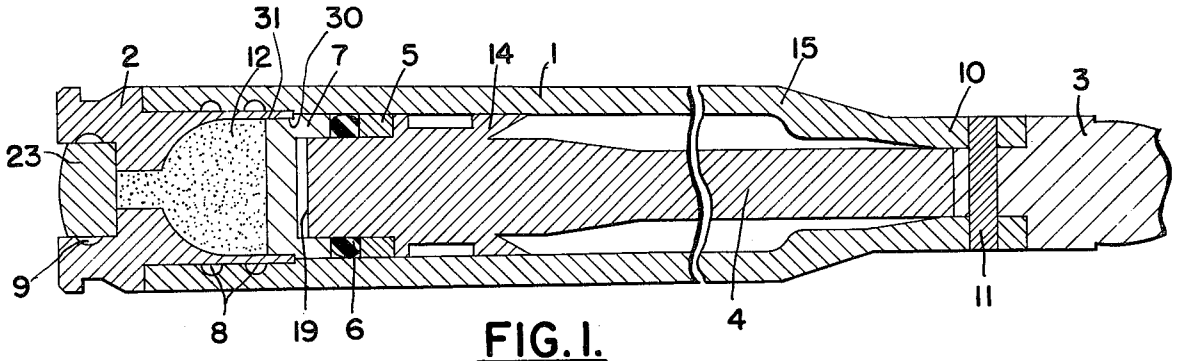

The invention described herein may be manufactured and used by or for the Government for governmental purposes without the payment to me of any royalty thereon.

This invention relates to ammunition. Its purpose is to provide an improved round or cartridge which may be fired from a conventional weapon without any effect which is detectable by visual, aural or infrared means.

It is sometimes desirable for psychological or other reason that the source of a fired projectile be undiscernable by one located in the area of the target. This involves the elimination of smoke, flash and blast. The sound caused by the shock wave of a projectile traveling above the velocity of sound is eliminated by keeping the velocity of the projectile slightly below the velocity of sound. The elimination of smoke and flash requires that the gas generated by the firing of a propellant be retained within the cartridge case. This tends to subject the case to forces by which it is so deformed as to render its extraction from the weapon difficult or impossible. These forces can also be destructive to the seals between the fixed and movable elements of the cartridge and to some of the movable elements themselves. The present invention avoids these difficulties by means of an improved construction whereby these forces are so directed and absorbed that their destructiveness is neutralized. Other outstanding features of the invention are seals which are operated by gas pressure to form a gas tight fit between certain elements of the cartridge and means whereby the headspacing of the cartridge may be automatically adjusted upon firing the cartridge.

The invention will be better understood from the following description when considered in connection with the accompanying drawings and its scope is indicated by the appended claims.

Figure 2:
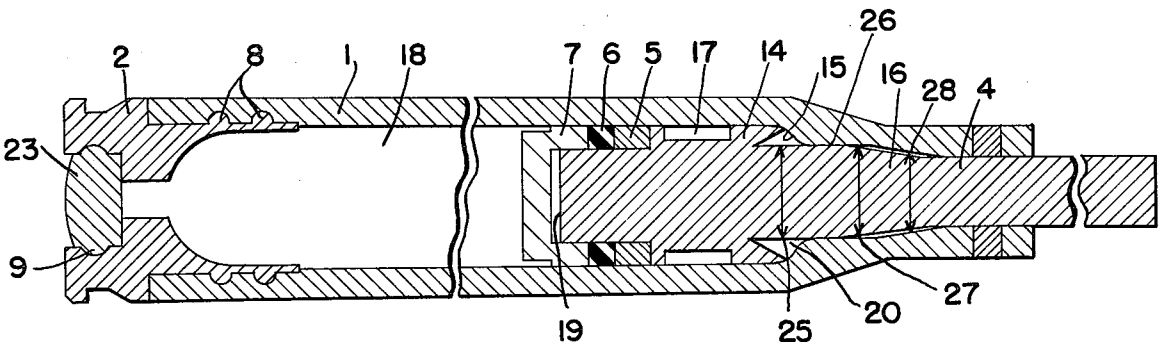
Figure 3:
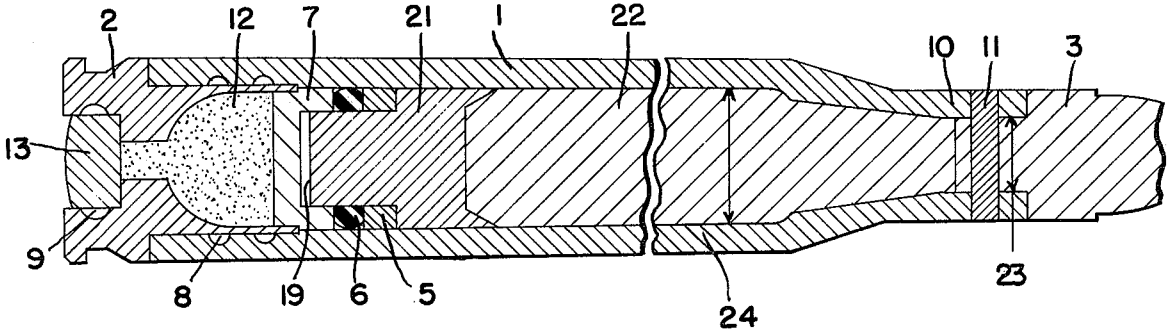
Figure 4:
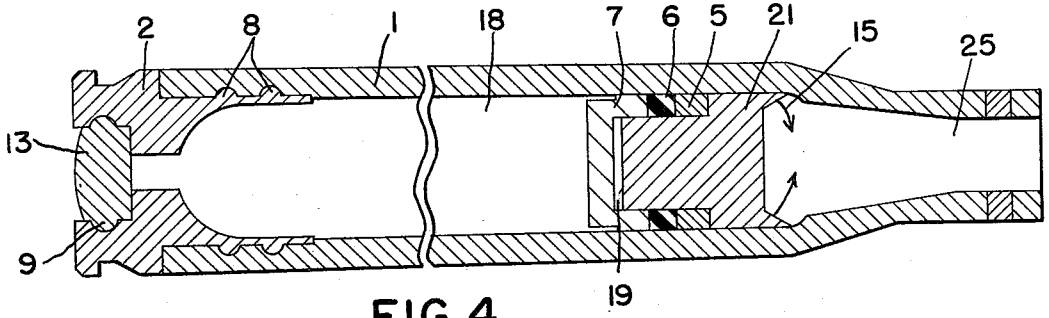

Referring to the drawings:

FIGS. 1 and 2 are sectional views of a cartridge wherein the projectile actuating member is a solid piston, FIG. 1 showing the cartridge as unfired, and FIG. 2 showing the cartridge as fired but before the piston has been stopped in its outward movement, FIG. 3 is a similar view of a cartridge wherein the projectile actuating member consists, in part, of a fluid, soft wax or other material which yields readily to pressure, FIG. 4 shows a sectional view of the cartridge of FIG. 3 after firing.

The cartridge of FIG. 1, includes a case 1, a head 2, a projectile 3, a piston 4, a back-up washer 5, an O-ring 6 and a base cup 7. The base cup 7 is made of cold rolled steel or titanium and serves a two-fold purpose. It is seated in the case head 2 after the propellant 12 has been loaded into the head and is secured by cement or other suitable means so that it is releasably coupled to the head. The force required to break this bond determines the point on the pressure-time curve at which the piston 4 and projectile 3 begins to move forward. This corresponds to the term "Bullet Pull" used in referring to the same force in conventional ammunition.

The base of the piston 4 is in the base cup 7 with a slide fit. The propellant gas in chamber 18 drives the cup against the O-ring 6, expanding it against the inner wall of the case, thus preventing the leakage of gas past this point. The depth of the cup 7 is such that it never seats against the rear surface 19 (FIG. 2) of the piston 4.

The design of the cartridge requires a thick walled rigid case. This case cannot be "crushed up" to accommodate variations in the "headspace" of rifles when the rifle bolt is closed. To render the cartridge self headspacing, the head 2 is made to have a slide fit in the rear end of the case 1. When the cartridge is assembled, the head is seated in the casing and cemented or knurled thereto with sufficient strength to permit handling, the dimensions of the case thus assembled being such that the rifle bolt can be closed in a minimum headspace chamber. When the cartridge is seated in other than a minimum headspace chamber, the propellant pressure forces the head 2 rearward against the bolt face, thus assuring that every cartridge has a zero headspace. The headspace is reduced to zero after ignition and before the case wall has been forced into the locking grooves by pressure of the propellant gas.

Referring to FIGS. 1 to 4, two annular grooves 8 can be seen on the inner periphery of the case 1. After the head has been forced rearward against the bolt face, the gas pressure generated by the firing of the propellant 12 continues to rise and, since the material of the head is softer than that of the case, the wall of the head is forced into the grooves 8 forming between the head and case a seal which is sufficiently strong to permit extraction of the case in the usual manner immediately after firing without the head being forced out of the case by the residual propellant gas pressure.

Due to residual gas pressure, it is also necessary (1) to prevent gas leakage between the primer 13 or 23 and the wall of the pocket in which it is mounted and (2) to assure that the primer case is not blown out of the pocket upon extraction of the fired cartridge. To this end, the primer pocket is provided with an annular groove 9 into which the wall of the primer is forced by the gas pressure, thus sealing it against leakage and locking it into the pocket. The primer may also be crimped in the conventional manner as an added precaution.

The base of the projectile 3 is in contact with the end of the piston 4. This juncture is in the short cylindrical section 10 of the case neck (FIG. 1) and assures proper alignment of the projectile and piston. The projectile 3 is supported in the neck of the case with a shear pin 11 or by knurling the base of the projectile or by other suitable means which provides sufficient support for handling and releasably couples the projectile to the case. The force required to release the projectile, however, should not be sufficient to cause buckling of the piston.

The cartridge of FIG. 1 is fired in the usual manner. When the propellant gas pressure reaches a value sufficient to break the bond between the base cup 7 and the case head 2, the rim of the base cup is driven against the O-ring 6 which then drives the piston 4 and projectile 3, thus imparting a forward velocity to the projectile. The piston and projectile continue to accelerate until the piston shoulder 14 meets the case shoulder 15. The velocity reached by the projectile at this point causes it to travel through the barrel of the rifle and on toward the target. The crush up of the piston shoulder against the shoulder 15 completely seals the propellant gas within the case as indicated at 14–15 in FIG. 2.

The distance the piston of a fired cartridge may be permitted to extend beyond the case neck varies for different rifles. In each case, this distance must be such as to permit extraction and ejection of the fired case.

The design of a nearly silent cartridge which will fire a lightweight projectile at a low velocity (of the order of 200 fps) and which is effective for a distance of only a few feet is a relatively simple problem.

The present invention has to do with a nearly silent cartridge which fires a projectile whose weight and velocity at 100 yards will have kinetic energy the order of 90 ft lbs to kill a human being.

The internal case design at the stop shoulder 15 and the design of the piston are critical factors. One problem encountered was breakage of the piston shank at the point 16, (FIG. 2), at the end of the stroke.

Initial deceleration of the piston 4 begins at the cylindrical section 25 of the piston due to its diameter being greater than that of the cylindrical section 26 of the case. The piston is further decelerated by crushing of the shoulder 14 against the shoulder 15, and is finally stopped by engagement of the tapered section 27 of the piston with the tapered section 28 of the case (FIG. 2). The relief groove 17 on the piston 4 permits the piston shoulder 14 to flow rearward during a later portion of the stroke instead of being forced outward against the case wall.

The design of the tapered shoulder on the piston 4 is the result of many failures of various designs and materials. As the collar is crushed, the metal flows radially inward toward the piston shank in the space 20 (FIG. 2), and later flows rearwardly into the groove 17. As shown in the drawing the shoulder 14 on the piston has a leading edge spaced from a body portion of the piston with the outer contact surface and an inner sloping surface forming an acute angle. On contact of shoulder 14 with an inner surface of casing shoulder 15 the metal of shoulder 14 is deformed flowing both radially inward at its leading edge and longitudinally rearwardly into groove 17. The casing shoulder 15 is shown having its outer surface sloping more gradually than its inner surface. The relief groove 17 has a greater length than its radial depth to provide space into which some of the material of shoulder 14 may flow in deceleration.

Approximately 115 ft lbs have to be absorbed by the case shoulder 15 at the end portion of the piston stroke. Since there is no gas pressure available for operating the rifle bolt, the fired case must be extracted manually. It is therefore necessary that case expansion be held within limits which will permit hand extraction.

The hydraulic piston type of cartridge shown in FIGS. 3, 4 differs from that previously described in that the solid piston is replaced by a piston consisting of a pusher 21 and a material 22 which flows as a result of the pressure exerted by the pusher. The material 22 may be a wax having a suitable viscosity, or a liquid material. It is forced through the neck of the case by the propellant gas acting on the pusher 21 and imparts velocity to the projection 3. The elements 21 and 22 thus form a hydraulic piston.

Since the material 22 is forced from the case body 24 through the smaller diameter of the case neck 23$^a$, there is an increase in its velocity as stated in Bernoulli's Principle. Experimental firing data shows a significant increase in velocity over the solid piston when both are fired with the same propellant charge and the same weight projectile. Since the diameters of the case neck and the rifle bore are smaller than the inside diameter of the case, the elongated hydraulic piston acts on the projectile for a longer time, thus increasing the velocity of the projectile.

As compared to the solid piston type of cartridge, the hydraulic piston type of cartridge has the disadvantage that a substance is ejected from the rifle barrel. It has the advantages that it eliminates the possibility of difficulty in the ejection of the fired case, the fired case more nearly resembles a conventional case, and the comparatively lightweight of the pusher 21 reduces the stopping energy which must be absorbed by the shoulder 15.

As utilized in a Special Caliber .30 cartridge, the case 1 is made of steel or other material of sufficient strength to withstand the propellant gas pressure and other internal forces. The piston 4 has the approximate dimensions and contours indicated by FIG. 1 when drawn to scale, and is made of the lightest material which will withstand the forces resulting from its acceleration by the propellant gases and its deceleration at the shoulder in the forward end of the case. Titanium meets these requirements.

The present cartridge is effective up to about 100 yards due to a higher velocity than had the prior art. A major cause of such higher velocity has been the use of a fast propellant of the type common in 22 Caliber long rounds. Here acceleration is confined to about an inch of effective piston travel and deceleration to about 0.125 inches. The ledge portion of the base cup 7 receiving the forward end of the head 2 may be tapered on about a 3° angle so that the forward end 30 of this ledge is slightly deeper than the rear end 31 of the ledge. The case head 2 crimped on the cartridge case 1 is therefore able to withstand a higher pressure before release of the base cup 7.

I claim:

1. A cartridge including a substantially rigid extractable case having at one of its ends a head formed to receive a propellant and to provide a primer support adjacent to said propellant, a projectile releasably coupled to the other end of said case, a piston engaging an inner end of said projectile and extending into said casing, said piston having a shoulder near its inner end, a base cup extending into and releasably coupled to said head, said cup enclosing the inner end of said piston with said end spaced from the bottom of said cup, and seal means between the rim of said cup and said shoulder, a second shoulder on said piston in front of the first shoulder, and a shoulder in said case for cooperation with the second mentioned shoulder on said piston in deceleration and deformation of said piston.

2. A cartridge according to claim 1 wherein the coupling between said projectile and said case is a shear pin.

3. A cartridge according to claim 1 wherein said piston is constituted in part of a material which flows under pressure, and a pusher for said fluid material, said pusher having a longitudinally tapered leading peripheral edge constituting the second mentioned shoulder on said piston, said peripheral edge being in sliding contact with an inner wall of said case.

4. A cartridge according to claim 1 wherein said case has an internal groove and said head encloses a propellant in a skirt extending over said groove and deformable into said groove upon the firing of said propellant whereby said head is locked to said case.

5. A cartridge according to claim 1 wherein said primer support is a recess with an internal groove and supports a primer with its casing extending over and deformable into said groove upon the firing of said primer whereby said primer is locked to said head.

6. A cartridge including a case having at one of its ends a head formed to receive a propellant and to support a primer adjacent to said propellant, said case having an internal shoulder near an opposite end from said propellant, a projectile releasably coupled to said other end of said case, a piston engaging the inner end of said projectile and extending into said casing, said piston having one shoulder near its inner end and another shoulder intermediate its ends for cooperation with said case shoulder, a base cup releasably coupled to said head, said cup enclosing the inner end of said piston with said end spaced from the bottom of said cup, and seal means between the rim of said cup and the first of said shoulders, the outer contour of said piston and the inner contour of said case being similarly tapered at a position longitudinally spaced from said shoulders such that motion of said piston is retarded first by a close fit between said case and piston, second by the crushing the intermediate shoulder of said piston against the internal shoulder of said case and third by engagement between tapered surfaces of said case and piston.

7. In a nearly silent round of ammunition substantially free from flash, said round comprising a case of strong hard substantially non-expandable metal, a propellant carried by said case, a projectile within said case, a piston between said propellant and projectile, and means for holding said piston and projectile against forward movement until pressure of propellant combustion products has reached a predetermined value to insure high velocity of the projectile and piston within a short distance of travel, the combination therewith of means for decelerating the piston within a minor fraction of the distance required for accelerating it, said decelerating means including a peripheral shoulder on said piston, one side of said shoulder being slidable within and in contact with said case, a leading edge of said shoulder forming an acute angle between said side contacting the case inner surface and a leading side sloping toward said piston with said leading edge being spaced from a body portion of said piston, an internal shoulder on said case sloping forwardly and located adjacent a place where deceleration of the piston begins whereby the said spaced leading edge of the piston shoulder is bent radially inward against said case shoulder to provide both a gas seal and a yieldable decelerating effect upon said piston, a body portion of said piston in rear of said first-mentioned shoulder being provided with a relief groove longer than its radial depth and into which material from said piston shoulder flows during its deceleration.

8. A combination according to claim 7 in which the casing and piston are provided with additional decelerating means in front of said cooperating piston and casing shoulders, said last-mentioned means comprising a tapered portion of said piston sloping forward and inward for engagement with the edges of a casing axial perforation of a size to effect a reduction in diameter and rearward flow of metal in said piston tapered portion.

9. A combination according to claim 7 in which said casing shoulder has a more gradual slope on the outside than it has on the inside.

10. A round of ammunition adapted to be fired without a detectable visual or aural effect, said round comprising a substantially rigid cartridge case, a projectile carried by said case, a propellant charge within said case, means whereby said charge may be fired, a piston in said case between said projectile and propellant, a forward portion of said case being provided with a shoulder by means of which said piston may be decelerated, a longitudinally tapered shoulder on said piston adapted to be deformed by said case shoulder and assist in sealing in products of combustion by said propellant as said shoulders engage in decelerating said piston, said piston being provided with a peripheral recess in rear of said piston shoulder and into which said piston shoulder may be at least partially deformed in deceleration, said piston being provided with an O ring on a rear portion, a base cup for compressing said O ring on firing said propellant, the base cup being spaced from a rear end wall of said piston to insure application of propellant pressure to said O ring, a shear pin connecting said projectile and case, said case shoulder being inclined at an angle of about 120°, a head inserted in a rear end of said case and around said propellant, said head having walls which are thinner and of softer material than said case, and a primer container for insertion in a rear wall of said head, said head wall being provided with a peripheral inner groove into which said primer container material may be expanded, said case and piston being similarly tapered at a position in front of said piston shoulder for assisting in deceleration of said piston and providing an additional tight fit for reduction in danger of gas leakage.

* * * * *